US011322087B1

(12) United States Patent
Beard et al.

(10) Patent No.: US 11,322,087 B1
(45) Date of Patent: May 3, 2022

(54) PIXEL CIRCUIT WITH THRESHOLD VOLTAGE COMPENSATION

(71) Applicant: SHARP KABUSHIKI KAISHA, Sakai (JP)

(72) Inventors: Oliver James Beard, Oxford (GB); Tong Lu, Swindon (GB)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/237,580

(22) Filed: Apr. 22, 2021

(51) Int. Cl.
*G09G 3/3233* (2016.01)
*G09G 3/32* (2016.01)

(52) U.S. Cl.
CPC ..... *G09G 3/3233* (2013.01); *G09G 3/32* (2013.01); *G09G 2300/0819* (2013.01); *G09G 2320/0233* (2013.01); *G09G 2330/02* (2013.01)

(58) Field of Classification Search
CPC ..... G09G 3/3233; G09G 3/32; G09G 2300/0819; G09G 2320/0233; G09G 2330/02
See application file for complete search history.

(56) References Cited

U.S. PATENT DOCUMENTS 7,414,599 B2 8/2008 Chung et al.
8,242,983 B2 8/2012 Yoo et al.
9,196,196 B2 11/2015 Chung et al.
9,202,409 B2 12/2015 Han
9,666,125 B2 5/2017 Chung
10,714,008 B1 7/2020 Lu
2018/0130412 A1* 5/2018 Zhang ..... G09G 3/3258
2019/0237010 A1 8/2019 Lin et al.
2019/0295467 A1* 9/2019 Lu ..... G09G 3/3233
2019/0295473 A1* 9/2019 Lu ..... G09G 3/3266
2020/0143742 A1 5/2020 Park et al.
2020/0211452 A1* 7/2020 Lee ..... G09G 3/3233
2021/0005138 A1* 1/2021 Umezawa ..... G09G 3/3233
2021/0193030 A1* 6/2021 Lee ..... G09G 3/3266
2021/0210013 A1* 7/2021 Lin ..... G09G 3/3233

* cited by examiner

*Primary Examiner* — Jeff Piziali
(74) *Attorney, Agent, or Firm* — ScienBiziP, P.C.

(57) ABSTRACT

A pixel circuit for a display device may be operable in three phases, including an initialization phase, a combined threshold compensation and data programming phase, and an emission phase. The pixel circuit may include a drive transistor configured to control an amount of current from a first power supply to a light-emitting device during the emission phase depending upon a voltage applied to a gate of the drive transistor. The pixel circuit may also include a second transistor and a third transistor that are connected in series between the gate and a second terminal of the drive transistor and are configured to implement the three phases. The pixel circuit may also include two capacitors, with one capacitor connected between the gate of the drive transistor and a first node of the circuit, and another capacitor connected between the gate and a second node of the circuit.

20 Claims, 5 Drawing Sheets

PIXEL CIRCUIT WITH THRESHOLD VOLTAGE COMPENSATION

FIELD

The present disclosure generally relates to electronic circuits, and in particular relates to control circuits for pixels of a display device, such as to deliver electrical current to an organic light-emitting diode (OLED) in a pixel of an active-matrix OLED (AMOLED) display device.

BACKGROUND

OLEDs generate light by recombination of electrons and holes. More specifically, OLEDs emit light when a bias is applied between the anode and cathode of the OLED such that electrical current passes between them. The brightness of the light is related to the amount of the current. If there is no current, there will be no light emission. As such, the OLED technology is a type of technology that is capable of absolute blacks which could achieve virtually infinite contrast ratio between pixels when used in display applications.

Conventionally, pixel thin-film transistor (TFT) circuits deliver current to an element of a display device, such as an OLED, through a drive transistor. In one example, an input signal, such as a high "SCAN" signal, may be provided to a switch transistor in the circuit to permit a data voltage "VDAT" to be stored at a storage capacitor during a programming phase of the circuit. When the SCAN signal is low and the switch transistor isolates the circuit from the data voltage, the VDAT voltage is retained by the capacitor, and this voltage is applied to a gate of the drive transistor. With the drive transistor having a threshold voltage $V_{TH}$, the amount of current to the OLED is related to the voltage on the gate of the drive transistor by way of the electrical current gain, or "beta," of the drive transistor.

TFT device characteristics, especially the TFT threshold voltage $V_{TH}$, may vary due to manufacturing processes and/or stress and aging of the TFT device during operation. With the same VDAT voltage, the amount of current delivered by the TFT drive transistor could vary by a large amount due to such threshold voltage variations from pixel to pixel. Therefore, pixels in a display may not exhibit uniform brightness for a given VDAT value. Similarly, OLED device characteristics may vary due to manufacturing processes and/or stress and aging during operation of the OLED. For example, the threshold voltage of the OLED for light emission may change. Conventional circuit configurations, therefore, often include elements that operate to compensate for at least some of these component variations to achieve an OLED display with more uniform brightness among sub-pixels.

Conventionally, therefore, OLED pixel circuits have high tolerance ranges to variations in threshold voltage and/or carrier mobility of the drive transistor by employing circuits that compensate for mismatch in the properties of the drive transistors. However, such circuits often create undesired issues, such as undesirable light emissions (e.g., compromised contrast ratio), reduced transistor drive current accuracy, poor power efficiency, enlarged circuit footprint, slow threshold compensation, and the like.

SUMMARY

The present disclosure is directed to a pixel circuit for a display device operable in an initialization phase, a combined threshold compensation and data programming phase, and an emission phase.

In accordance with one aspect of the present disclosure, a pixel circuit may include a first transistor serving as a drive transistor configured to control an amount of current from a first power supply to a light-emitting device during the emission phase depending upon a voltage applied to a gate of the drive transistor. The light-emitting device may include a first terminal that is connected to a first node and electrically connected to a first terminal of the drive transistor at a second node during at least the emission phase, and a second terminal that is connected to a second power supply. The pixel circuit may also include a second transistor and a third transistor that are connected in series between the gate and a second terminal of the drive transistor. During the initialization phase, the gate of the drive transistor may be electrically connected to the first power supply through the second transistor, and the second terminal of the drive transistor may be floating. During the combined threshold compensation and data programming phase, the gate and the second terminal of the drive transistor may be electrically connected together through the second and third transistors to diode-connect the drive transistor to compensate for a threshold voltage of the drive transistor. During the emission phase, the second terminal of the drive transistor may be supplied with the current from the first power supply through the third transistor. The pixel circuit may also include a first capacitor having a first plate that is connected to the gate of the drive transistor and a second plate that is connected to the second node. The pixel circuit may also include a second capacitor having a first plate that is connected to the gate of the drive transistor and the first plate of the first capacitor, and a second plate that is connected to the first node and electrically connected to the second node during the emission phase.

In an implementation of the first aspect, the pixel circuit may further include a fourth transistor configured to apply a data voltage to the second node during the combined threshold compensation and data programming phase.

In another implementation of the first aspect, the pixel circuit may further include a fifth transistor configured to electrically connect the first node to the second node during the initialization phase and the emission phase.

In another implementation of the first aspect, the pixel circuit may further include a sixth transistor configured to apply a reference voltage to the first node during the initialization phase and the combined threshold compensation and data programming phase.

In another implementation of the first aspect, the pixel circuit may further include a seventh transistor configured to connect the first power supply to a node that connects the second and third transistors during the initialization phase and the emission phase.

In another implementation of the first aspect, the reference voltage may be less than a sum of a threshold voltage of the light-emitting device and a voltage of the second power supply.

In another implementation of the first aspect, at least one of the second transistor, the fourth transistor, and the sixth transistor may include a dual-gate transistor.

In another implementation of the first aspect, the drive transistor, the second transistor, the third transistor, the fourth transistor, the fifth transistor, the sixth transistor, and the seventh transistor may include n-type transistors, and at least one of the second transistor, the fourth transistor, and the sixth transistor may include an indium gallium zinc oxide transistor.

In another implementation of the first aspect, the display device may include a plurality of light-emitting devices arranged in a plurality of rows, the light-emitting device may be located in an nth row of the plurality of rows, and at least one control signal of the second transistor or the third transistor may also be employed as a control signal for at least one transistor of another light-emitting device in an (n−x)th row of the plurality of rows.

In another implementation of the first aspect, the light-emitting device may be one of an organic light-emitting diode (OLED), a micro light-emitting diode (micro LED), or a quantum dot light-emitting diode (QLED).

In another implementation of the first aspect, the drive transistor, the second transistor, and the third transistor may include p-type transistors. In yet another implementation of the first aspect, the drive transistor, the second transistor, and the third transistor may include n-type transistors.

In accordance with a second aspect of the present disclosure, a method of operating a pixel circuit for a display device may include providing a pixel circuit. The pixel circuit may include a first transistor that includes a drive transistor configured to control an amount of current from a first power supply to a light-emitting device during an emission phase depending upon a voltage applied to a gate of the drive transistor. The light-emitting device may include a first terminal that is connected to a first node and a second terminal that is connected to a second power supply. The pixel circuit may also include a first capacitor having a first plate that is connected to the gate of the drive transistor, and a second plate that is connected to a first terminal of the drive transistor at a second node. The pixel circuit may also include a second capacitor having a first plate that is connected to the gate of the drive transistor, and a second plate that is connected to the first node. The pixel circuit may also include a plurality of switch transistors coupled to the drive transistor, the light-emitting device, the first capacitor, and the second capacitor.

The method may also include performing an initialization that includes floating a second terminal of the drive transistor, connecting the first power supply to the gate of the drive transistor; and applying a reference voltage to the second node. The method may also include a combined threshold compensation and data programming phase that includes electrically connecting the gate and the second terminal of the drive transistor together to diode-connect the drive transistor, and electrically disconnecting the first node and the second node. The combined threshold compensation and data programming phase also includes applying the reference voltage to the first node and applying a data voltage to the second node. Further, at an end of the combined threshold compensation and data programming phase, the method may include electrically disconnecting the gate of the drive transistor from the second terminal of the drive transistor, electrically disconnecting the first node from the reference voltage, and electrically disconnecting the second node from the data voltage. The method may also include performing the emission phase, which includes electrically connecting the first node to the second node, and electrically connecting the first power supply to the second terminal of the drive transistor.

In an implementation of the second aspect, the reference voltage may be less than a sum of a threshold voltage of the light-emitting device and a voltage of the second power supply.

In an implementation of the second aspect, the plurality of switch transistors may include a second transistor and a third transistor that are connected in series between the gate and the second terminal of the drive transistor.

In an implementation of the second aspect, the first power supply may be connected to a connection between the second transistor and the third transistor.

In an implementation of the second aspect, the plurality of switch transistors may further include a fourth transistor that electrically connects the second node to the data voltage during the combined threshold compensation and data programming phase.

In an implementation of the second aspect, the plurality of switch transistors may further include a fifth transistor that electrically connects the first node and the second node during the initialization phase and the emission phase.

In an implementation of the second aspect, the plurality of switch transistors may further include a sixth transistor that electrically connects the first node and the reference voltage during the initialization phase and the combined threshold compensation and data programming phase.

In an implementation of the second aspect, the plurality of switch transistors may further include a seventh transistor that electrically connects the first power supply to a connection between the second transistor and the third transistor during the initialization phase and the emission phase.

BRIEF DESCRIPTION OF DRAWINGS

Aspects of the example disclosure are best understood from the following detailed description when read with the accompanying figures. Various features are not drawn to scale. Dimensions of various features may be arbitrarily increased or reduced for clarity of discussion.

DESCRIPTION

Figure 1:
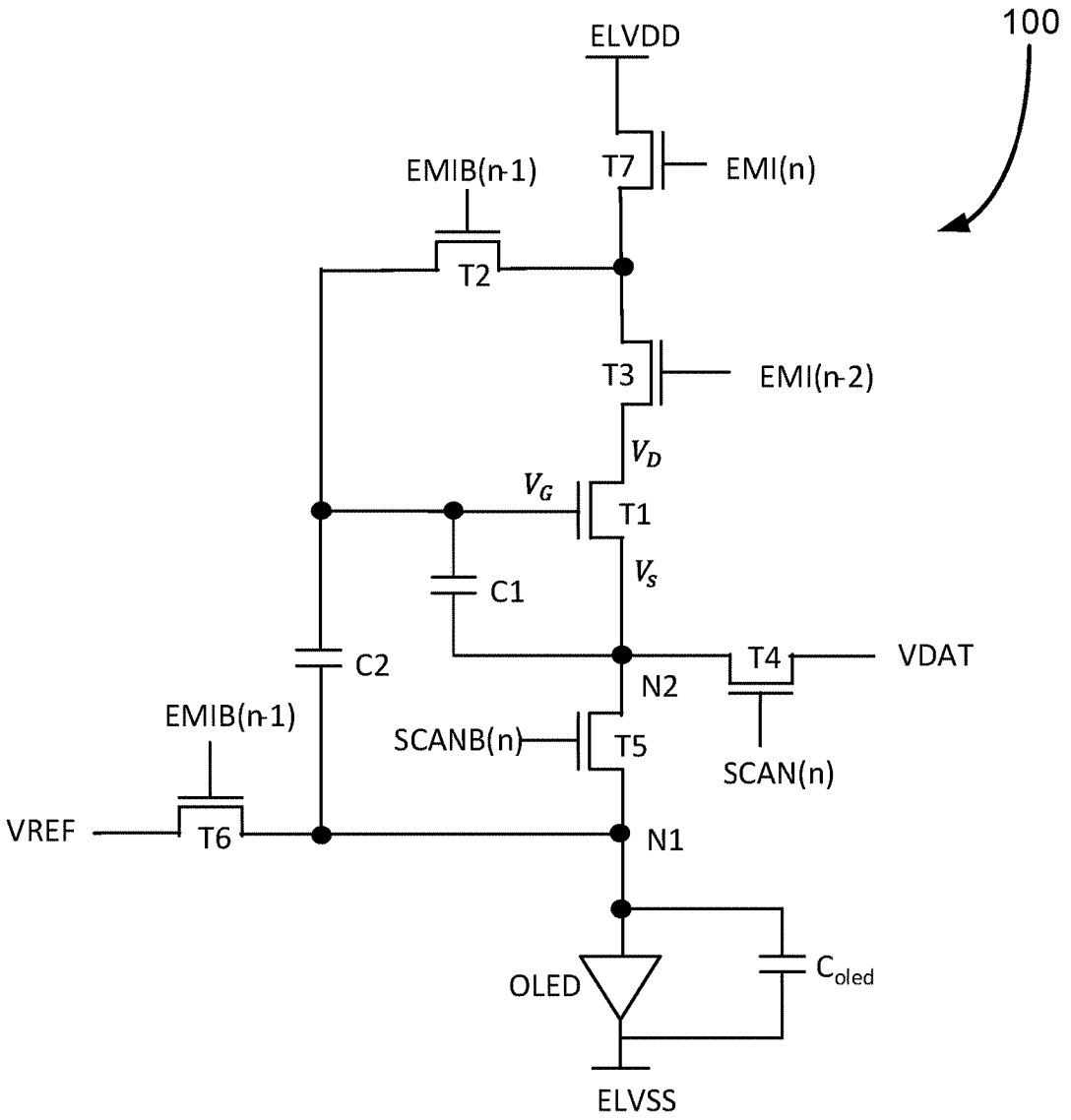
FIG. 1 is a schematic of a first circuit configuration, in accordance with an example implementation of the present disclosure.

The following description contains specific information pertaining to exemplary implementations in the present disclosure. The drawings and their accompanying detailed description are directed to exemplary implementations. However, the present disclosure is not limited to these exemplary implementations. Other variations and implementations of the present disclosure will occur to those skilled in the art. Unless noted otherwise, like or corresponding elements in the figures may be indicated by like or corresponding reference numerals. Moreover, the drawings and illustrations are generally not to scale and are not intended to correspond to actual relative dimensions.

For consistency and ease of understanding, like features are identified (although, in some examples, not shown) by numerals in the exemplary figures. However, the features in different implementations may be different in other respects, and therefore will not be narrowly confined to what is shown in the figures.

The phrases "in one implementation" and "in some implementations" may each refer to one or more of the same or different implementations. The term "coupled" is defined as connected, whether directly or indirectly via intervening components, and is not necessarily limited to physical connections. The term "comprising" means "including, but not necessarily limited to" and specifically indicates open-ended inclusion or membership in the described combination, group, series, and equivalent.

Additionally, any two or more of the following paragraphs, (sub)-bullets, points, actions, behaviors, terms, alternatives, examples, or claims described in the following disclosure may be combined logically, reasonably, and properly to form a specific method. Any sentence, paragraph, (sub)-bullet, point, action, behavior, term, or claim described in the following disclosure may be implemented independently and separately to form a specific method. Dependency, e.g., "according to", "more specifically", "preferably", "in one embodiment", "in one implementation", "in one alternative", etc., in the following disclosure refers to just one possible example which would not restrict the specific method.

For explanation and non-limitation, specific details, such as functional entities, techniques, protocols, and standards, are set forth for providing an understanding of the described technology. In other examples, detailed description of well-known methods, technologies, systems, and architectures are omitted so as not to obscure the description with unnecessary details.

Also, while certain directional references (e.g., top, bottom, up, down, height, width, and so on) are employed in the description below and appended claims, such references are utilized to provide guidance regarding the positioning and dimensions of various elements relative to each other and are not intended to limit the orientation of the various embodiments to those explicitly discussed herein.

Various embodiments of a pixel circuit that are described below may compensate for the threshold voltage variations of the drive transistor and the voltage variations of the light-emitting device (e.g., an OLED) being driven. In at least some examples, the threshold voltage of the drive transistor and the data voltage may be programmed to at least one capacitor connected between the gate and the source of the drive transistor. The current variation due to the threshold voltage variations of the drive transistor may be cancelled during an emission phase, at which time the light-emitting device is driven to emit light. Any voltage variations at the source of the drive transistor, which may be caused by the variations of the OLED performance, may cause similar voltage changes at the gate of the drive transistor. Hence, the voltage between the gate and source of the drive transistor may remain the same. The current controlled by the drive transistor may be related to the voltage difference between the gate and the source, and thus the current through the drive transistor and to the OLED may not be affected by the variations of the OLED performance.

To achieve such results, the drive transistor may be initialized (e.g., during an initialization phase) so that the gate and source of the drive transistor are connected to supply voltages while the drain of the drive transistor is floating, thereby preventing the drive transistor from drawing any current during the initialization phase. Following this, a two-capacitor structure may be used for a combined threshold compensation and data programming phase. In embodiments discussed below, two capacitors, $C_1$ and $C_2$, are used for threshold compensation, with the data voltage being applied at the source of the drive transistor. The threshold voltage of the drive transistor and the data voltage may be stored in a first capacitor $C_1$, and the threshold voltage of the drive transistor may be stored in a second capacitor $C_2$ during the combined threshold compensation and data programming phase. The data voltage may be distributed between the two capacitors. During the emission phase, the second plates of the capacitors $C_1$ and $C_2$ may be electrically connected to the same node, which may also be connected to an anode of the OLED. The threshold voltage of the drive transistor and the data voltage may be programmed to both the capacitors, which are both electrically connected between the gate and source of the drive transistor during the emission phase. In this manner, the current variation caused by the variations of the threshold voltage of the drive transistor may be cancelled during the emission phase. In addition, any variations of voltage across the OLED which may alter the voltage at the source of the drive transistor may cause a similar voltage change at the gate of the drive transistor, and thus will not affect the current sourced by the drive transistor. Consequently, the OLED luminance may not be affected by the variations of the OLED performance due to the OLED voltage. The connection of the plates of the capacitors in parallel during the emission phase may further stabilize the voltage applied between the gate and source of the drive transistor due to increasing the capacitance, which may further reduce emission variations.

Therefore, in some embodiments, a pixel circuit for a display device may initialize the gate and source of the drive transistor while the drain of the drive transistor is floating, such that no current is drawn through the drive transistor during this phase of operation. Consequently, the initial gate-source voltage of the drive transistor may be highly controlled. This control may be achieved by controlling a switching transistor that connects to the drain of the drive transistor and can therefore leave the drain floating when the switching transistor is turned off during the initialization phase. At other times, this switching transistor may be turned on, such that during a threshold compensation phase may become part of the diode-connected path between the gate and the source of the drive transistor, which may allow threshold compensation to occur. Subsequently, during the emission phase, this transistor may become part of the path from the power supply to the drive transistor itself.

Also, in some embodiments, a pixel circuit for a display device may employ a two-capacitor configuration, as mentioned above, in which, during the emission phase, the corresponding first and second plates of the capacitors may be electrically connected to each other to provide more stability to the gate voltage of the drive transistor by combining the capacitances of both capacitors to provide a greater overall capacitance. The pixel circuit may also be operable in a combined threshold compensation and data programming phase to compensate for variations in the characteristics of the drive transistor and the light-emitting device.

Figure 2:
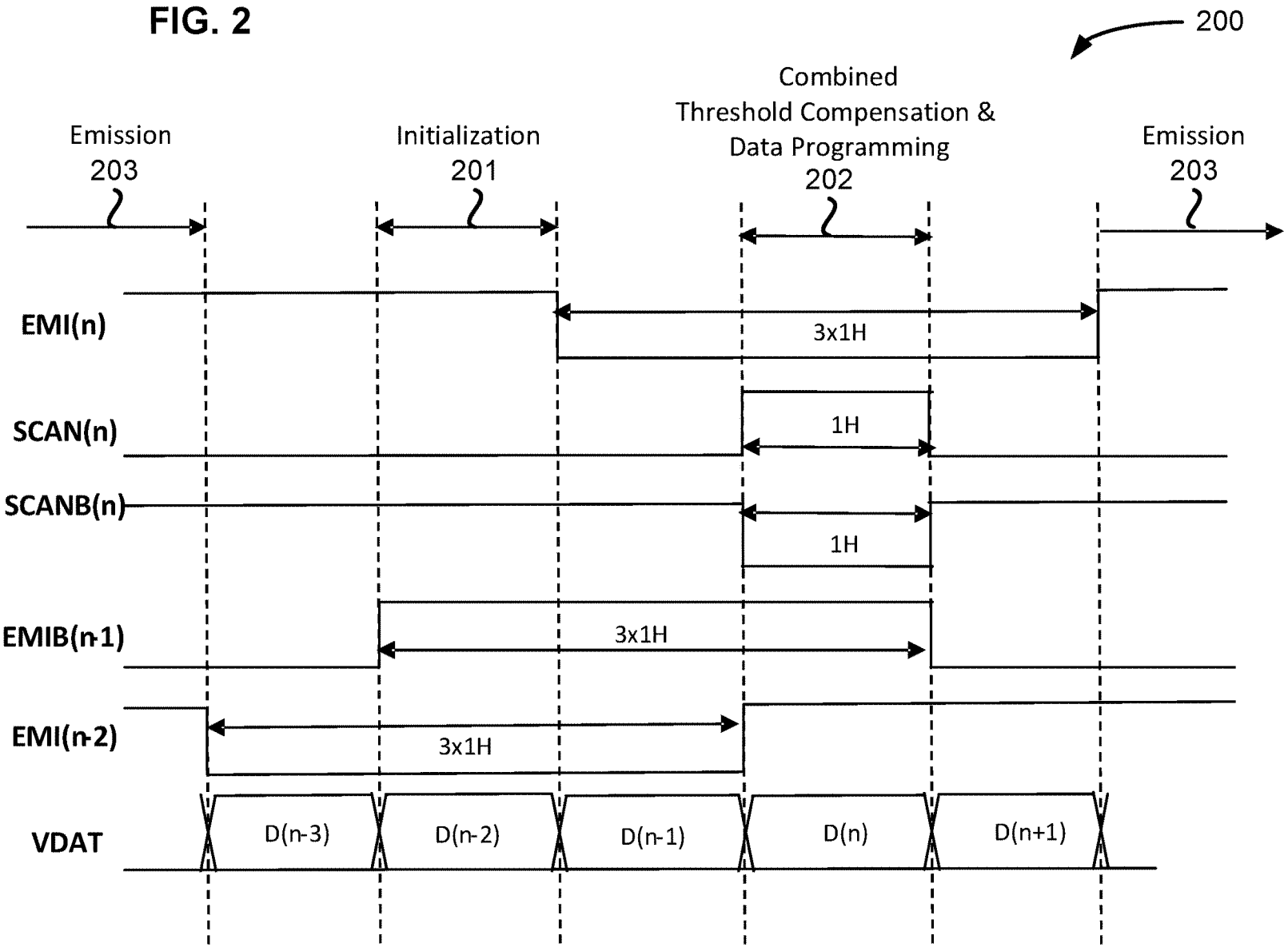
FIG. 2 is a timing diagram associated with the operation of the circuit configuration of FIG. 1, in accordance with an example implementation of the present disclosure.

FIG. 1 is a schematic depicting a first circuit configuration 100 in accordance with embodiments of the present disclosure, and FIG. 2 is a timing diagram associated with the operation of circuit configuration 100 of FIG. 1. In this example, circuit configuration 100 is a TFT circuit configuration that includes multiple n-type transistors T1-T7 and two capacitors $C_1$ and $C_2$. The circuit elements drive a light-emitting device, such as an OLED. The OLED has an associated internal capacitance, which is represented in the circuit diagram as $C_{oled}$. In addition, although the embodiments are described principally in connection with an OLED as the light-emitting device, comparable principles may be used with display technologies that employ other types of light-emitting devices, including, for example, micro-LEDs and quantum dot LEDs. In the example of FIG. 1, power may be supplied to circuit configuration 100 by a first power supply ELVDD and a second power supply ELVSS.

More specifically, FIG. 1 depicts circuit configuration 100 as including multiple n-MOS or n-type TFTs. More specifically, circuit configuration 100 includes a drive transistor T1 (e.g., an analogue TFT) and digital switch transistors T2-T7 (e.g., digital switch TFTs). In FIG. 1 and subsequent figures, the terminals (and associated voltages) of drive transistor T1 are labeled gate ($V_G$), source ($V_S$), and drain ($V_D$). As referenced above, $C_1$ and $C_2$ are capacitors, and $C_{oled}$ is the internal capacitance of the OLED device (i.e., $C_{oled}$ is not a separate component, but is inherent to the OLED). The OLED further is connected to second power supply ELVSS, as is conventional.

The OLED and circuit configuration 100, including transistors T1-T7, capacitors $C_1$ and $C_2$, and connecting wires, may be fabricated using TFT fabrication processes conventional in the art. It will be appreciated that comparable fabrication processes may be employed to fabricate the TFT circuits according to any of the embodiments.

For example, circuit configuration 100 (and subsequent embodiments) may be disposed on a substrate, such as a glass, plastic, or metal substrate. Each TFT T1-T7 may include a gate electrode, a gate insulating layer, a semiconducting layer, a first electrode, and a second electrode. The semiconducting layer may be disposed on the substrate. The gate insulating layer may be disposed on the semiconducting layer, and the gate electrode may be disposed on the insulating layer. The first electrode and second electrode may be disposed on the insulating layer and connected to the semiconducting layer using vias. The first electrode and second electrode may commonly be referred to as the "source electrode" and "drain electrode," respectively, of TFTs T1-T7. Capacitors $C_1$ and $C_2$ may comprise a first electrode connected to a first plate, an insulating layer, and a second electrode connected to a second plate, whereby the insulating layer forms an insulating barrier between the first and second plates. Wiring between components in the circuit, and wiring used to introduce signals to the circuit (e.g., a SCAN signal, an EMI (emission) signal, a VDAT (data voltage) signal, and a VREF (reference voltage) signal) may comprise metal lines or a doped semiconductor material. For example, metal lines may be disposed between the substrate and the gate electrode of a TFT and connected to electrodes using vias. The semiconductor layer may be deposited by chemical vapor deposition, and metal layers may be deposited by a thermal evaporation technique.

The OLED device may be disposed over TFT circuit configuration 100. The OLED device may include a first electrode (e.g., an anode of the OLED), which is connected to transistors T5 and T6 at a first node N1 in this example. The OLED device may also include one or more layers for injecting or transporting charge (e.g., holes) to an emission layer, the emission layer, one or more layers for injecting or transporting electrical charge (e.g., electrons) to the emission layer, and a second electrode (e.g., a cathode of the OLED), which is connected to second power supply ELVSS in this example. In some embodiments, the injection layers, transport layers, and emission layer may include organic materials, the first and second electrodes may be metals, and all of these layers may be deposited by a thermal evaporation technique.

In some embodiments, a display device may include multiple OLEDs and associated pixel circuits (e.g., circuit configuration 100) that are arranged in rows, with the OLEDs in a particular row being provided with data for the current video frame simultaneously. Further, in some examples, the frame data for each row of OLEDs may be updated in order, from top to bottom, before starting at the top row again for the next frame. In such an arrangement, circuit configuration 100 for pixels in a particular row may be controlled using control signals EMI, SCAN, and their complementary signals (e.g., EMIB and SCANB) that are employed for other rows of pixels, thereby enabling fewer control signal wires in a display configuration, as common control lines may be shared by different rows. For this example and in subsequent embodiments, display pixels are addressed by row and column. The current row is row n. The previous row is row n−1, and the second previous row is row n−2. The next row after the current row is row n+1, and the row after that is row n+2, and so on for the various rows as they relate to the corresponding control signals identified in the figures. Accordingly, for example, SCAN(n) refers to the scan signal at row n and SCAN(n+1) refers to the scan signal at row n+1, and the like. EMI(n) refers to the emission signal at row n and EMI(n−1) refers to the emission signal at row n−1, and the like, and so on for the various control signals. In this manner, for the various embodiments, the input signals correspond to the indicated rows. While particular embodiments described herein employ signals from rows n, n−1, and n−2 for pixel circuits of row n, signals from other previous rows (e.g., row n−x, more generally) may be employed in other embodiments.

Referring to circuit configuration 100 of FIG. 1, in combination with a timing diagram 200 of FIG. 2, circuit configuration 100 operates to perform in three phases: an initialization phase 201, a combined threshold compensation and data programming phase 202, and an emission phase 203 for light emission. In some aspects of the present embodiments, during a previous emission phase 203, signals EMI(n) and EMI(n−2) have a (relative) high voltage value, so transistors T7 and T3 are "on," or closed. With transistors T7 and T3 being on, the light emission is being driven by first power supply ELVDD connected to the drive transistor T1 through transistors T7 and T3, whereby the actual current applied to the OLED is determined by the voltage potential across the gate and source of drive transistor T1. During this same phase, signal SCANB(n) has a high voltage value, so transistor T5 is on. With transistor T5 being on, the anode of the OLED and the second plate of capacitor $C_2$ (at first node N1) are electrically connected to the second plate of capacitor $C_1$ and the source terminal of drive transistor T1 (at a second node N2), and the effective storage capacitance is the combined parallel capacitance of the capacitor $C_1$ and $C_2$. As shown in FIG. 1, the first plate of each of capacitors $C_1$ and $C_2$ is connected to the gate of drive transistor T1, and thus to each other. Signals SCAN(n) and EMIB(n−1) initially have a low voltage value so that transistors T2, T4, and T6 are "off," or open.

Before initialization phase 201 begins, signal EMI(n−2) is changed from the high voltage value to a (relative) low voltage value, causing transistor T3 to turn off. With transistor T3 turning off, the drain of drive transistor T1 becomes disconnected from first power supply ELVDD, thus preventing drive transistor T1 from drawing current from first power supply ELVDD and sinking it to the OLED. Therefore, at this point the OLED ceases emitting light.

At the beginning of initialization phase 201, signal EMIB (n−1) is changed from the low voltage value to a high voltage value, causing transistors T2 and T6 to turn on. With transistor T2 turning on, the gate of drive transistor T1 becomes electrically connected to first power supply ELVDD through transistors T2 and T7. The drain terminal of drive transistor T1 remains floating because transistor T3 remains off, so current may not be drawn through drive transistor T1 itself despite the gate terminal being pulled to a high potential. In addition, transistors T2 and T7 are operating as digital switches, so very little current is drawn by each of them, and the voltage written to the gate terminal of the drive transistor is approximately the same voltage as first power supply ELVDD. With transistor T6 turning on, the source terminal of drive transistor T1 becomes electrically connected to reference voltage VREF through transistors T6 and T5. As transistors T6 and T5 are being operated as digital switches and drive transistor T1 is not turned on, very little current is being drawn through transistors T6 and T5, such that the voltage written to the source of drive transistor T1 is approximately the same as reference voltage VREF. The voltages stored across the terminals of capacitors $C_1$ and $C_2$ is therefore the difference between first power supply ELVDD and reference voltage VREF, or $V_{ELVDD}$ $V_{REF}$.

With transistor T6 turned on, voltage reference VREF is applied to first node N1 corresponding to the connection of the anode of the OLED and the second plate of capacitor $C_2$. In at least some examples, to avoid light emission, reference voltage VREF may be below the threshold voltage $V_{OLED_TH}$ of the OLED plus second power supply ELVSS:

$$V_{REF}<V_{OLED_TH}+V_{ELVSS}$$

Initialization phase 201, in the various embodiments, is configured to clear memory effects on circuit configuration 100 from the previous frame (e.g., prior emission phase 203). In addition, because of transistor T3 being off during initialization phase 201, any voltage potential can be set across the gate and source voltage terminals of drive transistor T1, which may impact how strongly drive transistor T1 is turned on in later phases. Because none of the control signals used in this operation (e.g., EMI(n−2), EMIB(n−1), and EMI(n)) are linked to the data writing operation, the speed that the video data needs to be written to the panel is not determined by the time required to perform initialization phase 201. Consequently, the speed of initialization phase 201 does not limit the speed of the data writing and enables faster 1H times to be used, where 1H is approximately the length of time that video data for a particular row is available on data voltage signal VDAT.

Next, at the end of initialization phase 201, signal EMI(n) is changed from the high voltage value to the low voltage value, causing transistor T7 to turn off. With transistor T7 turned off, the gate terminal of drive transistor T1 becomes disconnected from first power supply ELVDD and is floating. Capacitors $C_1$ and $C_2$ hold the gate terminal of drive transistor T1 at the voltage potential to which it was initialized during initialization phase 201.

Next, before the start of combined threshold compensation and data programming phase 202, signal EMI(n−2) is changed from the low voltage value to the high voltage value, causing transistor T3 to turn on. With transistor T3 turned on, the gate and drain of drive transistor T1 are electrically connected through transistors T2 and T3, resulting in drive transistor T1 being diode-connected, by which the current can only flow in one direction. Diode-connected refers to drive transistor T1 being operated with its gate and a second terminal (e.g., source or drain, and in this case the drain) being electrically connected, such that current flows in one direction (e.g., for an n-type device, flowing out of the terminal that is not connected to the gate, or for a p-type device, flowing into the terminal that is not connected to the gate). In FIG. 2, this operation is illustrated as occurring at the start of combined threshold compensation and data programming phase 202. However, this operation may happen any time between the end of initialization phase 201 and the start of combined threshold compensation and data programming phase 202, and circuit configuration 100 may still operate as intended.

Next, at the start of combined threshold compensation and data programming phase 202, signal SCANB(n) is changed from the high voltage value to a low voltage value, causing transistor T5 to turn off. With transistor T5 turning off, first node N1, corresponding to a connection of the second plate of capacitor $C_2$ and the anode of the OLED, is disconnected from second node N2, corresponding to a connection of the second plate of capacitor $C_1$ and the source of drive transistor T1. Consequently, first node N1 remains connected to reference voltage VREF, but second node N2 is no longer connected to reference voltage VREF and is now floating.

Simultaneously, at the start of combined threshold compensation and data programming phase 202, signal SCAN(n) is changed from the low voltage value to a high voltage value, causing transistor T4 to turn on. With transistor T4 turned on, second node N2, corresponding to a connection of the second plate of capacitor $C_1$ and the source of drive transistor T1, is connected to data voltage VDAT. Prior to or in conjunction with the change in signal SCAN(n), data voltage VDAT is changed from the value for another pixel (e.g., data for the previous row of the display, D(n−1)) to the data value for the current pixel (e.g., data for the current row of the display, D(n)). In some embodiments, such timing helps ensure that data voltage VDAT presents the correct voltage level for the current row while signal SCAN(n) is active.

The source of drive transistor T1 is now electrically connected through T4 to data voltage VDAT. As the drain and the gate of drive transistor T1 are diode-connected through transistors T2 and T3, the voltage level of the drain and gate of drive transistor T1 may drop from its initial level of $V_{ELVDD}$ from first power supply ELVDD toward the lower data voltage VDAT:

$$V_{ELVDD}-V_{DAT}>\Delta V+V_{TH}$$

In the above relationship, $V_{TH}$ is the threshold voltage of drive transistor T1, and ΔV is a voltage that is large enough to generate a high initial current to charge capacitor $C_1$ within an allocated threshold compensation time. The value of ΔV may depend on the properties of the transistors. For example, ΔV may be at least 3 volts for exemplary low-temperature polycrystalline silicon TFT processes. In other embodiments employing other types of transistors, ΔV may be some other voltage value. Accordingly, the voltage level $V_{DAT}$ of data voltage VDAT may be set to satisfy the voltage requirement:

$$V_{DAT}<V_{ELVDD}-\Delta V-V_{TH}$$

At the end of the threshold compensation, current may not be flowing from the gate/drain of drive transistor T1 to the source of drive transistor T1. The voltage at the gate/drain of drive transistor T1, which is connected to the first plates of capacitors $C_1$ and $C_2$, becomes the sum of $V_{DAT}$ and $V_{TH}$:

$$V_G=V_D=V_{DAT}+V_{TH}$$

Next, during combined threshold compensation and data programming phase 202, signal SCAN(n) is changed from the high voltage value to the low voltage value, causing transistor T4 to turn off. With transistor T4 turning off, the second plate of capacitor $C_1$ and the source of drive transistor T1 are disconnected from data voltage VDAT that supplies $V_{DAT}$. At this point, data voltage VDAT changes to the data value for the subsequent row. At the same time, signal SCANB(n) is changed from the low voltage value to the high voltage value, causing transistor T5 to turn on. With transistor T5 turning on, first node N1 corresponding to the second plate of capacitor $C_2$ and the anode of the OLED is electrically connected to second node N2 corresponding to the second plate of capacitor $C_1$ and the source of drive transistor T1.

Also, at the same time, signal EMIB(n−1) is changed from the high voltage value to the low voltage value, causing transistors T2 and T6 to turn off. With transistor T2 turning off, the gate and the drain of drive transistor T1 are disconnected, and thus drive transistor T1 is no longer diode-connected. With transistor T6 turning off, first node N1 is disconnected from reference voltage VREF.

Thereafter, circuit configuration 100 is operable in emission phase 203, during which the OLED is capable of emitting light with a driving current supply being supplied from first power supply ELVDD through transistor T7. Signal EMI(n) is changed from the low voltage value to the high voltage value, causing transistor T7 to turn on to supply first power supply ELVDD as the driving current supply for drive transistor T1.

Referring to the voltage at the anode of OLED as $V_{OLED}$, the first plates of capacitors $C_1$ and $C_2$, as well as the gate of drive transistor T1, are floating at this point, and the total change in electrical charge at the first plates is as follows:

$$(V_{OLED}-V_{DAT})C_1+(V_{OLED}-V_{REF})C_2$$

Ignoring the parasitic capacitance at the gate of drive transistor T1, the voltage change at the first plates is as shown below:

$$\frac{(V_{OLED}-V_{DAT})C_1+(V_{OLED}-V_{REF})C_2}{C_1+C_2}=V_{OLED}-\frac{V_{DAT}C_1+V_{REF}C_2}{C_1+C_2}$$

The voltage at the first plates of capacitor $C_1$ and $C_2$, and thus at the gate of drive transistor T1, becomes as follows:

$$V_G=V_{DAT}+V_{TH}+V_{OLED}-\frac{V_{DAT}C_1+V_{REF}C_2}{C_1+C_2}$$

Consequently, the current that flows through the LED is as follows:

$$I_{OLED}=\frac{\beta}{2}\left(V_{DAT}+V_{TH}+V_{OLED}-\frac{V_{DAT}C_1+V_{REF}C_2}{C_1+C_2}-V_{OLED}-V_{TH}\right)^2=\frac{\beta}{2}\left(\frac{C_2(V_{DAT}-V_{REF})}{C_1+C_2}\right)^2$$

where $$\beta=\mu_n\cdot C_{ox}\cdot\frac{W}{L}$$

is the electrical current gain, or "beta," of drive transistor T1, $C_{ox}$ is the capacitance of the drive transistor gate oxide, W is the width of the drive transistor channel, L is the length of the channel of drive transistor T1 (i.e., the distance between source and drain), and $\mu_n$ is the carrier mobility of drive transistor T1.

Accordingly, the current through the OLED does not depend on either the threshold voltage of drive transistor T1 or the voltage variations of the OLED. In this manner, variation in the threshold voltage of drive transistor T1 and the voltage variations of the OLED have been compensated.

During emission phase 203, therefore, the first plates of both capacitors $C_1$ and $C_2$ are connected to each other and to the gate of drive transistor T1, and the second plates of both capacitors $C_1$ and $C_2$ are electrically connected to each other and to the anode of the OLED and the source of drive transistor T1.

Accordingly, the voltage across both capacitors is utilized for driving the OLED during emission phase 203. In at least some embodiments, a certain capacitance is desired to maintain a stable voltage at the gate of drive transistor T1 during emission phase 203 to achieve stable light emission. With capacitors $C_1$ and $C_2$ connected commonly at the first and second plates during emission phase 203, smaller capacitors may be employed for capacitors $C_1$ and $C_2$ compared to conventional configurations to achieve comparable performance and stability of the light emission. Such use of smaller capacitors may be advantageous in high-resolution displays in which spatial limitations are significant.

Figure 3:
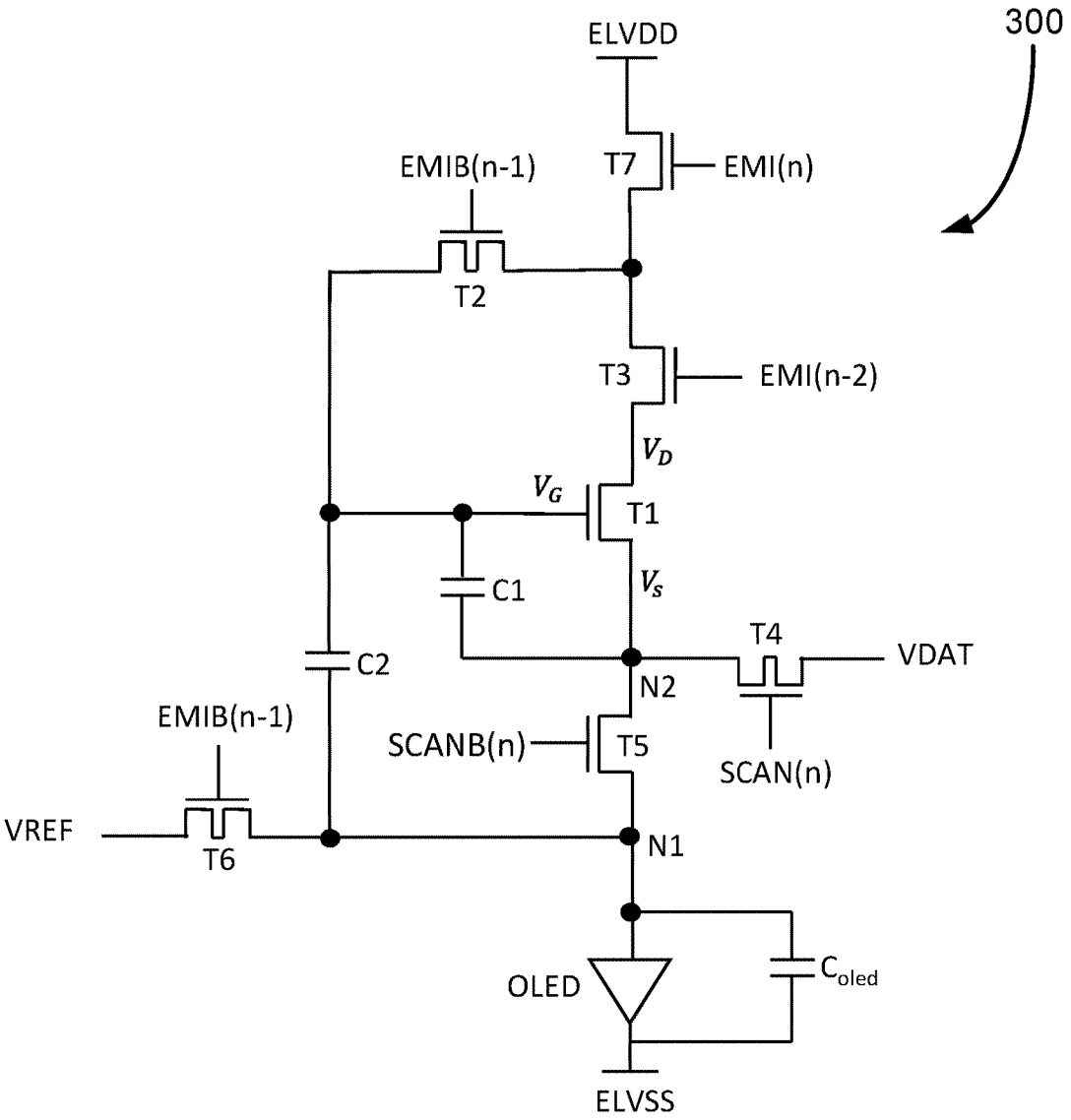
FIG. 3 is a schematic of a second circuit configuration, in accordance with an example implementation of the present disclosure.

FIG. 3 is a schematic depicting a second circuit configuration 300 in accordance with example embodiments of the present disclosure. The timing and the operational method of circuit configuration 300 may essentially be the same as the first circuit configuration 100. The difference between first circuit configuration 100 and second circuit configuration 300 is that transistors T2, T4, and T6 are configured as dual-gate transistors in second circuit configuration 300. Compared to first circuit configuration 100, the benefit of the dual-gate transistors in second circuit configuration 300 is that the leakage current from the capacitors $C_1$ and $C_2$ may be reduced, and thus the drift of the voltage between the gate and source of drive transistor T1 may be reduced as well. Instead of using dual-gate transistors to reduce leakage current, transistors T2, T4, and/or T6 may alternatively be ultra-low leakage single-gate TFTs, such as an indium gallium zinc oxide (IGZO) TFT, to achieve a comparable effect of reduced leakage.

One of the factors that may affect the amount of the leakage current is the "off" resistance of switch transistors T2, T4, and T6. Due to process variations resulting from variations in manufacturing and property changes over usage, device mismatch may affect the off resistance. The amount of the leakage current may result in emission variations across the display panel. A reduced leakage current, such as by using dual-gate or IGZO transistors as referenced above, may result in less variation in the display.

Figure 4:
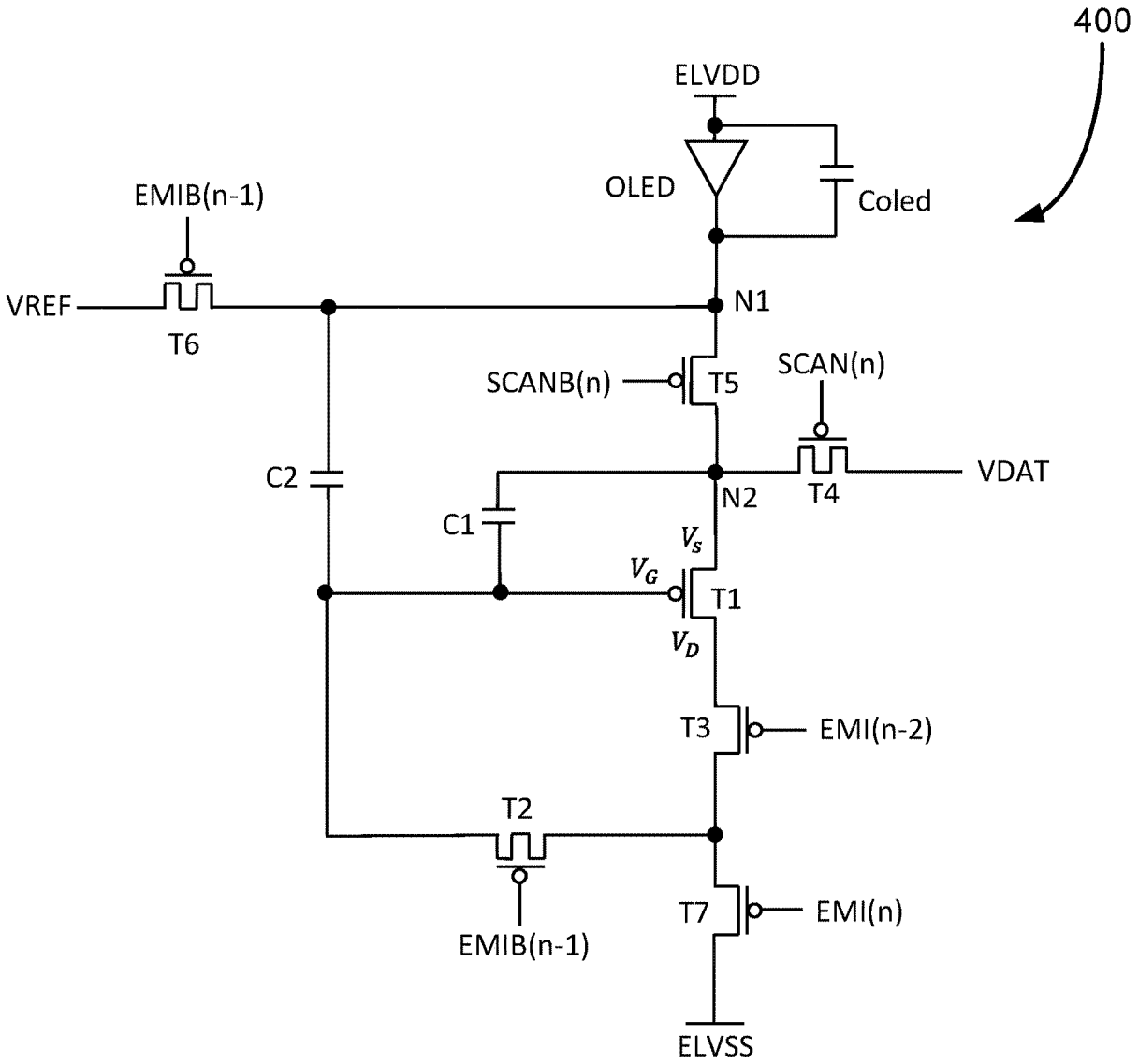
FIG. 4 is a schematic of a third circuit configuration, in accordance with an example implementation of the present disclosure.
Figure 5:
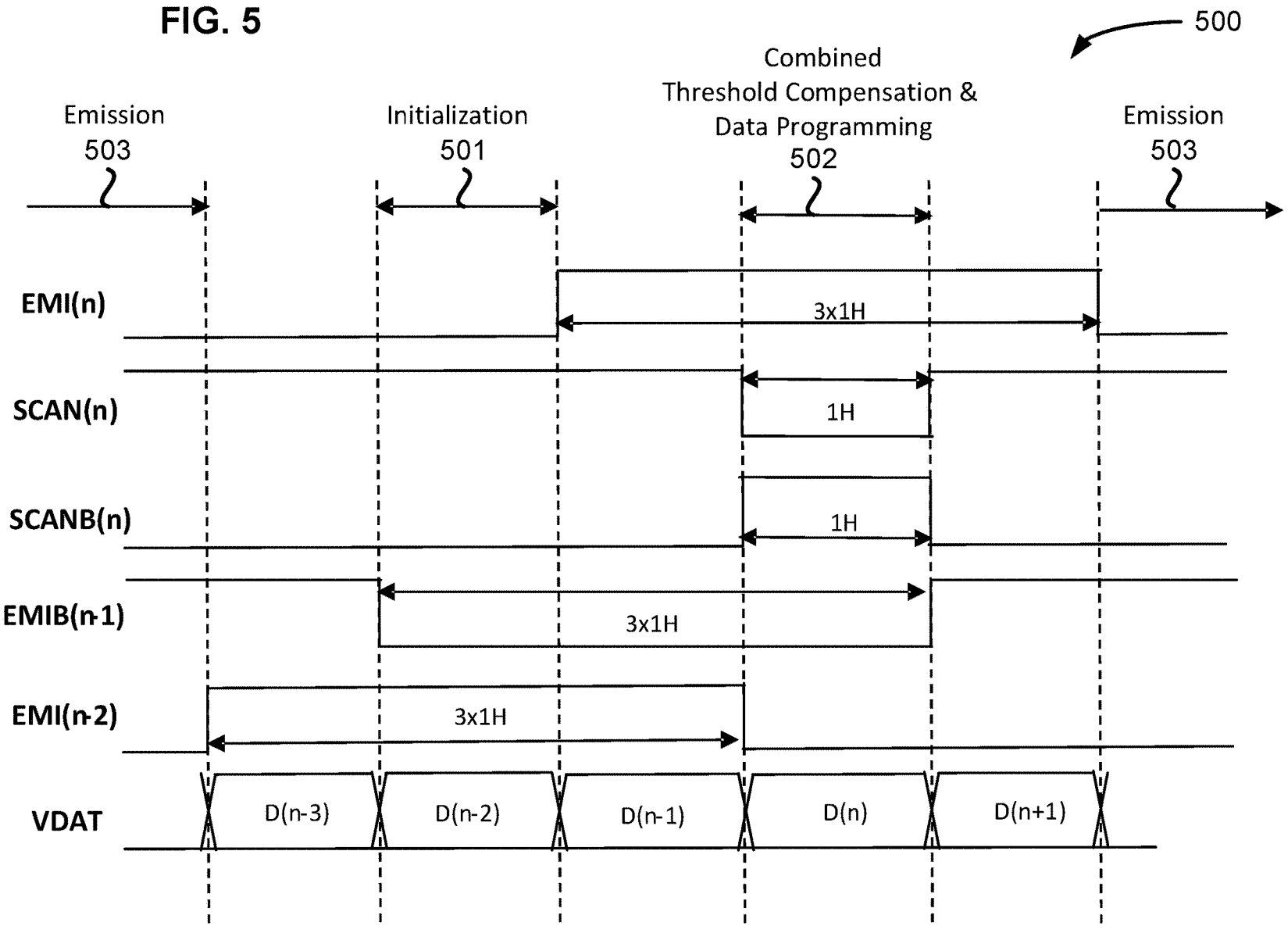
FIG. 5 is a timing diagram associated with the operation of the circuit configuration of FIG. 4, in accordance with an example implementation of the present disclosure.

FIG. 4 is a schematic depicting a third circuit configuration 400 in accordance with example embodiments of the present disclosure, and FIG. 5 is a timing diagram 500 associated with the operation of third circuit configuration 400 of FIG. 4. Third circuit configuration 400 may operate comparably as first circuit configuration 100 and second circuit configuration 300 of FIGS. 1 and 3, respectively, except that third circuit configuration 400 may employ p-type transistors for transistors T1-T7 rather than n-type transistors. As is known in the art, the drive properties of an OLED may be more suitable for n-type versus p-type transistors, and the principles of the present disclosure are applicable to either type of configuration. Accordingly, in the example of FIG. 4, third circuit configuration 400 is configured as a TFT circuit that includes multiple p-MOS or p-type TFTs and two capacitors $C_1$ and $C_2$. The circuit elements drive a light-emitting device, such as an OLED. As discussed above, the OLED has an associated internal capacitance, which is represented in FIG. 4 as $C_{oled}$. In addition, although the embodiments are described principally in connection with an OLED as the light-emitting device, comparable principles may be used with display technologies that employ other types of light-emitting devices, including, but not limited to, micro-LEDs and quantum dot LEDs.

Similarly, as in the embodiments discussed above, drive transistor T1 may be an analogue TFT, and T2-T6 may be digital switch TFTs. Capacitors $C_1$ and $C_2$ are included, and $C_{oled}$ is the internal capacitance of the OLED device (i.e., $C_{oled}$ is not a separate component, but is inherent to the OLED). The OLED is also connected to a second power supply (in this case, ELVDD). In addition, transistors T2, T3, and T5 are depicted as being low leakage, dual-gate transistors, comparably as in second circuit configuration 300 of FIG. 3. As an alternative, single-gate transistors comparably as in first circuit configuration 100 of FIG. 1 may be employed.

Referring to third circuit configuration 400 of FIG. 4 in combination with timing diagram 500 of FIG. 5, third circuit configuration 400 operates to perform in three phases: an initialization phase 501, a combined threshold compensation and data programming phase 502, and an emission phase 503 for light emission, which are comparable to initialization phase 201, combined threshold compensation and data programming phase 202, and emission phase 203, respectively, as discussed above in conjunction with FIG. 2. As referenced above, third circuit configuration 300 of FIG. 4 operates comparably as first circuit configuration 100 and second circuit configuration 300 of FIGS. 1 and 3, respectively, except that third circuit configuration 400 employs p-type transistors rather than n-type transistors. Accordingly, the principal difference of operation as illustrated in FIGS. 2 and 5 is the relative voltage levels of the input control signals (e.g., high voltage versus low voltage values) being set to operate with p-type transistors. Further, given the use of p-type transistors, third circuit configuration 400 is substantially inverted between supply voltages ELVDD and ELVSS, with the exception of the cathode of OLED (as opposed to the anode of OLED) being connected to first node N1. Consequently, where ELVDD remains at a higher voltage than ELVSS, as those supply voltages are employed in first circuit configuration 100 and second circuit configuration 300, the roles of those supply voltages are reversed. More specifically, in third circuit configuration 400, ELVSS serves as the first supply voltage, and ELVDD serves as the second supply voltage, as those terms are referenced above.

In some aspects of the present embodiments, during a previous emission phase 503, signals EMI(n) and EMI(n−2) have a low voltage value, so transistors T7 and T3 are on. With transistors T7 and T3 being on, the light emission is being driven by first power supply ELVSS connected to the drive transistor T1 through transistors T7 and T3, whereby the actual current applied to the OLED is determined by the voltage across the gate and source of drive transistor T1. During this same phase, signal SCANB(n) has a low voltage value, so transistor T5 is on. With transistor T5 being on, the cathode of the OLED and the second plate of capacitor $C_2$ (at first node N1) are electrically connected to the second plate of capacitor $C_1$, and source terminal of drive transistor T1 (at second node N2), and the effective storage capacitance is the combined parallel capacitance of the capacitor $C_1$ and $C_2$. As shown in FIG. 5, the first plate of each of capacitors $C_1$ and $C_2$ is connected to the gate of drive transistor T1, and thus each other. Signals SCAN(n) and EMIB(n−1) initially have a high voltage value so that transistors T2, T4, and T6 are off.

Before initialization phase 501 begins, signal EMI(n−2) is changed from the low voltage value to a high voltage value, causing transistor T3 to turn off. With transistor T3 turning off, the drain of drive transistor T1 becomes disconnected from first power supply ELVSS, thus preventing drive transistor T1 from drawing current from first power supply ELVSS and sinking it from the OLED. Therefore, at this point the OLED ceases emitting light.

At the beginning of initialization phase 501, signal EMIB (n−1) is changed from the high voltage value to a low voltage value, causing transistors T2 and T6 to turn on. With transistor T2 turning on, the gate of drive transistor T1 becomes electrically connected to first power supply ELVSS through transistors T2 and T7. The drain terminal of drive transistor T1 remains floating because transistor T3 remains off, so current may not be drawn through drive transistor T1 itself despite the gate terminal being pulled to a low potential. In addition, transistors T2 and T7 are operating as digital switches, so very little current is drawn by each of them, and the voltage written to the gate terminal of drive transistor T1 is approximately the same voltage as first power supply ELVSS. With transistor T6 turning on, the source terminal of drive transistor T1 becomes electrically connected to reference voltage VREF through transistors T6 and T5. As transistors T6 and T5 are being operated as digital switches and drive transistor T1 is not turned on, very little current is being drawn through transistors T6 and T5, such that the voltage written to the source of the drive transistor is approximately the same as reference voltage VREF. The voltages stored across the terminals of capacitors $C_1$ and $C_2$ is therefore the difference between reference voltage VREF and first power supply ELVSS, or $V_{REF}-V_{ELVSS}$.

With transistor T6 turned on, voltage reference VREF is applied to first node N1 corresponding to the connection of the cathode of the OLED and the second plate of capacitor $C_2$. In at least some examples, to avoid light emission, reference voltage VREF may be above the threshold voltage $V_{OLED_TH}$ of the OLED subtracted from second power supply ELVDD:

$$V_{REF}>V_{ELVDD}-V_{OLED_TH}$$

Initialization phase 501 in the various embodiments is configured to clear memory effects on third circuit configuration 400 from the previous frame (e.g., prior emission phase 503). In addition, because of transistor T3 being off during initialization phase 501, any voltage potential can be set across the gate and source voltage terminals of drive transistor T1, which may impact how strongly drive transistor T1 is turned on in later phases. Because none of the control signals used in this operation (e.g., EMI(n−2), EMIB (n−1), and EMI(n)) are linked to the data writing operation, the speed that the video data needs to be written to the panel is not determined by the time required to perform initialization phase 501. Consequently, the speed of initialization phase 501 does not limit the speed of the data writing and enables faster 1H times to be used, where 1H is approximately the length of time that video data for a particular row is available on the data voltage signal VDAT.

Next, at the end of initialization phase 501, signal EMI(n) is changed from the low voltage value to the high voltage value, causing transistor T7 to turn off. With transistor T7 turned off, the gate terminal of drive transistor T1 becomes disconnected from first power supply ELVSS and is floating. Capacitors $C_1$ and $C_2$ hold the gate terminal of drive transistor T1 at the voltage potential to which it was initialized during initialization phase 501.

Next, before the start of combined threshold compensation and data programming phase 502, signal EMI(n−2) is changed from the high voltage value to the low voltage value, causing transistor T3 to turn on. With transistor T3 turned on, the gate and drain of drive transistor T1 are electrically connected through transistors T2 and T3, resulting in drive transistor T1 being diode-connected, by which the current can only flow in one direction. Diode-connected refers to drive transistor T1 being operated with its gate and a second terminal (e.g., source or drain, and in this case the drain) being electrically connected, such that current flows in one direction (e.g., for an n-type device, flowing out of the terminal that is not connected to the gate, or for a p-type device, flowing into the terminal that is not connected to the gate). In FIG. 5, this operation is illustrated as occurring at the start of combined threshold compensation and data programming phase 502. However, this operation may happen any time between the end of initialization phase 501 and the start of combined threshold compensation and data programming phase 502, and third circuit configuration 400 may still operate as intended.

Next, at the start of combined threshold compensation and data programming phase 502, signal SCANB(n) is changed from the low voltage value to a high voltage value, causing transistor T5 to turn off. With transistor T5 turning off, first node N1, corresponding to a connection of the second plate of capacitor $C_2$ and the cathode of the OLED, is disconnected from second node N2, corresponding to a connection of the second plate of capacitor $C_1$ and the source of drive transistor T1. Consequently, first node N1 remains connected to reference voltage VREF, but second node N2 is no longer connected to reference voltage VREF and is now floating.

Simultaneously, at the start of combined threshold compensation and data programming phase 502, signal SCAN (n) is changed from the high voltage value to a low voltage value, causing transistor T4 to turn on. With transistor T4 turned on, second node N2, corresponding to a connection of the second plate of capacitor $C_1$ and the source of drive transistor T1, is connected to data voltage VDAT. Prior to or in conjunction with the change in signal SCAN(n), data voltage VDAT is changed from the value for another pixel (e.g., data for the previous row of the display, D(n−1)) to the data value for the current pixel (e.g., data for the current row of the display, D(n)). In some examples, this timing helps ensure that data voltage VDAT presents the correct voltage level for the current row while signal SCAN(n) is active.

The source of drive transistor T1 is now electrically connected through T4 to data voltage VDAT. As the drain and the gate of drive transistor T1 are diode-connected through transistors T2 and T3, the voltage level of the drain and gate of drive transistor T1 may rise from its initial level of $V_{ELVSS}$ from first power supply ELVSS toward the higher data voltage VDAT:

$$V_{DAT}-V_{ELVSS}>\Delta V+|V_{TH}|$$

In the above relationship, $V_{TH}$ is the threshold voltage of drive transistor T1 (e.g., often stated as a negative voltage for a p-type transistor), and ΔV is a voltage that is large enough to generate a high initial current to charge capacitor $C_1$ within an allocated threshold compensation time. The value of ΔV may depend on the properties of the transistors. For example, ΔV may be at least 3 volts for exemplary low-temperature polycrystalline silicon TFT processes. In other embodiments employing other types of transistors, ΔV may be some other voltage value. Accordingly, the voltage level $V_{DAT}$ of data voltage VDAT may be set to satisfy the voltage requirement:

$$V_{DAT}>V_{ELVSS}+\Delta V+|V_{TH}|$$

At the end of the threshold compensation, current may not be flowing from the gate/drain of drive transistor T1 to the source of drive transistor T1. The voltage at the gate/drain of drive transistor T1, which is connected to the first plates of capacitors $C_1$ and $C_2$, becomes the difference between $V_{DAT}$ and $V_{TH}$:

$$V_G=V_D=V_{DAT}-|V_{TH}|$$

Next during combined threshold compensation and data programming phase 502, signal SCAN(n) is changed from the low voltage value to the high voltage value, causing transistor T4 to turn off. With transistor T4 turning off, the second plate of capacitor $C_1$ and the source of drive transistor T1 are disconnected from data voltage VDAT that supplies $V_{DAT}$. At this point, data voltage VDAT can change to the data value for the subsequent row. At the same time, signal SCANB(n) is changed from the high voltage value to the low voltage value, causing transistor T5 to turn on. With transistor T5 turning on, first node N1 corresponding to the second plate of capacitor $C_2$ and the cathode of the OLED is electrically connected to second node N2 corresponding to the second plate of capacitor $C_1$ and the source of drive transistor T1.

Also, at the same time, signal EMIB(n−1) is changed from the low voltage value to the high voltage value, causing transistors T2 and T6 to turn off. With transistor T2 turning off, the gate and the drain of drive transistor T1 are disconnected, and thus drive transistor T1 is no longer diode-connected. With transistor T6 turning off, first node N1 is disconnected from reference voltage VREF.

Thereafter, third circuit configuration 400 is operable in emission phase 503, during which the OLED is capable of emitting light with a driving current source being supplied from first power supply ELVSS through transistor T7. Signal EMI(n) is changed from the high voltage value to the low voltage value, causing transistor T7 to turn on to supply first power supply ELVSS as the driving current source for drive transistor T1.

Referring to the voltage at the cathode of OLED as $V_{OLED}$, the first plates of capacitors $C_1$ and $C_2$, as well as the gate of drive transistor T1, are floating at this point, and the total change in electrical charge at the first plates is as follows:

$$(V_{OLED}-V_{DAT})C_1+(V_{OLED}-V_{REF})C_2$$

Ignoring the parasitic capacitance at the gate of drive transistor T1, the voltage change at the first plates is as shown below:

$$\frac{(V_{OLED}-V_{DAT})C_1+(V_{OLED}-V_{REF})C_2}{C_1+C_2}=V_{OLED}-\frac{V_{DAT}C_1+V_{REF}C_2}{C_1+C_2}$$

The voltage at the first plates of capacitor $C_1$ and $C_2$, and thus at the gate of drive transistor T1, becomes as follows:

$$V_G = V_{DAT} - |V_{TH}| + V_{OLED} - \frac{V_{DAT}C_1 + V_{REF}C_2}{C_1 + C_2}$$

Consequently, the current that flows through the LED is as follows:

$$I_{OLED} = \frac{\beta}{2}\left(V_{DAT} - |V_{TH}| + V_{OLED} - \frac{V_{DAT}C_1 + V_{REF}C_2}{C_1 + C_2} - V_{OLED} + |V_{TH}|\right)^2 = \frac{\beta}{2}\left(\frac{C_2(V_{DAT} - V_{REF})}{C_1 + C_2}\right)^2$$

where $$\beta = \mu_n \cdot C_{ox} \cdot \frac{W}{L}$$

is the electrical current gain, or "beta," of drive transistor T1, $C_{ox}$ is the capacitance of the drive transistor gate oxide, W is the width of the drive transistor channel, L is the length of the channel of drive transistor T1 (i.e., the distance between source and drain), and $\mu_n$ is the carrier mobility of drive transistor T1.

Accordingly, the current through the OLED does not depend on either the threshold voltage of drive transistor T1 or the voltage variations of the OLED. In this manner, variation in the threshold voltage of the drive transistor and the voltage variations of the OLED have been compensated.

During emission phase 503, therefore, the first plates of both capacitors $C_1$ and $C_2$ are connected to each other and to the gate of drive transistor T1, and the second plates of both capacitors $C_1$ and $C_2$ are electrically connected to each other and to the cathode of the OLED and the source of drive transistor T1.

Accordingly, the voltage across both capacitors is utilized for driving the OLED during emission phase 503. In at least some embodiments, a certain capacitance is desired to maintain a stable voltage at the gate of drive transistor T1 during emission phase 503 to achieve stable light emission. With capacitors $C_1$ and $C_2$ connected commonly at the first and second plates during emission phase 503, smaller capacitors may be employed for capacitors $C_1$ and $C_2$ compared to conventional configurations to achieve comparable performance and stability of the light emission. Such use of smaller capacitors may be advantageous in high-resolution displays in which spatial limitations are significant.

Embodiments of the present invention are applicable to many display devices to permit display devices of high resolution with effective threshold voltage compensation and true black performance. Examples of such devices include televisions, mobile phones, personal digital assistants (PDAs), tablet and laptop computers, desktop monitors, digital cameras, and like devices for which a high-resolution display is desirable.

From the above discussion, it is evident that various techniques can be utilized for implementing the concepts of the present disclosure without departing from the scope of those concepts. Moreover, while the concepts have been described with specific reference to certain implementations, a person of ordinary skill in the art would recognize that changes can be made in form and detail without departing from the scope of those concepts. As such, the disclosure is to be considered in all respects as illustrative and not restrictive. It should also be understood that the present disclosure is not limited to the particular described implementations, but that many rearrangements, modifications, and substitutions are possible without departing from the scope of the present disclosure.

What is claimed is:

1. A pixel circuit for a display device operable in an initialization phase, a combined threshold compensation and data programming phase, and an emission phase, the pixel circuit comprising:

a first transistor comprising a drive transistor configured to control an amount of current from a first power supply to a light-emitting device during the emission phase depending upon a voltage applied to a gate of the drive transistor, the light-emitting device comprising:

a first terminal that is connected to a first node and electrically connected to a first terminal of the drive transistor at a second node during at least the emission phase; and a second terminal that is connected to a second power supply;

a second transistor and a third transistor that are connected in series between the gate and a second terminal of the drive transistor and are configured such that:

during the initialization phase, the gate of the drive transistor is electrically connected to the first power supply through the second transistor, and the second terminal of the drive transistor is floating;

during the combined threshold compensation and data programming phase, the gate and the second terminal of the drive transistor are electrically connected together through the second and third transistors to diode-connect the drive transistor to compensate for a threshold voltage of the drive transistor; and during the emission phase, the second terminal of the drive transistor is supplied with the current from the first power supply through the third transistor;

a first capacitor having a first plate that is connected to the gate of the drive transistor and a second plate that is connected to the second node; and a second capacitor having a first plate that is connected to the gate of the drive transistor and the first plate of the first capacitor, and a second plate that is connected to the first node, and electrically connected to the second node during the emission phase.

2. The pixel circuit of claim 1, further comprising a fourth transistor configured to apply a data voltage to the second node during the combined threshold compensation and data programming phase.

3. The pixel circuit of claim 2, further comprising a fifth transistor configured to electrically connect the first node to the second node during the initialization phase and the emission phase.

4. The pixel circuit of claim 3, further comprising a sixth transistor configured to apply a reference voltage to the first node during the initialization phase and the combined threshold compensation and data programming phase.

5. The pixel circuit of claim 4, further comprising a seventh transistor configured to connect the first power supply to a node that connects the second and third transistors during the initialization phase and the emission phase.

6. The pixel circuit of claim 5, wherein the reference voltage is less than a sum of a threshold voltage of the light-emitting device and a voltage of the second power supply.

7. The pixel circuit of claim 5, wherein at least one of the second transistor, the fourth transistor, and the sixth transistor comprises a dual-gate transistor.

8. The pixel circuit of claim 5, wherein the drive transistor, the second transistor, the third transistor, the fourth transistor, the fifth transistor, the sixth transistor, and the seventh transistor comprise n-type transistors, and at least one of the second transistor, the fourth transistor, and the sixth transistor comprises an indium gallium zinc oxide transistor.

9. The pixel circuit of claim 1, wherein:

the display device comprises a plurality of light-emitting devices arranged in a plurality of rows;

the light-emitting device is located in an nth row of the plurality of rows; and at least one control signal of the second transistor or the third transistor is also employed as a control signal for at least one transistor of another light-emitting device in an (n−x)th row of the plurality of rows.

10. The pixel circuit of claim 1, wherein the light-emitting device is one of an organic light-emitting diode (OLED), a micro light-emitting diode (micro LED), or a quantum dot light-emitting diode (QLED).

11. The pixel circuit of claim 1, wherein the drive transistor, the second transistor, and the third transistor comprise p-type transistors.

12. The pixel circuit of claim 1, wherein the drive transistor, the second transistor, and the third transistor comprise n-type transistors.

13. A method of operating a pixel circuit for a display device, the method comprising:

providing a pixel circuit comprising:

a first transistor comprising a drive transistor configured to control an amount of current from a first power supply to a light-emitting device during an emission phase depending upon a voltage applied to a gate of the drive transistor;

the light-emitting device comprising:

a first terminal that is connected to a first node; and a second terminal that is connected to a second power supply;

a first capacitor having a first plate that is connected to the gate of the drive transistor, and a second plate that is connected to a first terminal of the drive transistor at a second node;

a second capacitor having a first plate that is connected to the gate of the drive transistor, and a second plate that is connected to the first node; and a plurality of switch transistors coupled to the drive transistor, the light-emitting device, the first capacitor, and the second capacitor;

performing an initialization phase comprising:

floating a second terminal of the drive transistor;

connecting the first power supply to the gate of the drive transistor; and applying a reference voltage to the second node;

performing a combined threshold compensation and data programming phase, comprising:

electrically connecting the gate and the second terminal of the drive transistor together to diode-connect the drive transistor;

electrically disconnecting the first node and the second node;

applying the reference voltage to the first node;

applying a data voltage to the second node; and at an end of the combined threshold compensation and data programming phase, electrically disconnecting the gate of the drive transistor from the second terminal of the drive transistor, electrically disconnecting the first node from the reference voltage, and electrically disconnecting the second node from the data voltage; and performing the emission phase, comprising:

electrically connecting the first node to the second node; and electrically connecting the first power supply to the second terminal of the drive transistor.

14. The method of claim 13, wherein the reference voltage is less than a sum of a threshold voltage of the light-emitting device and a voltage of the second power supply.

15. The method of claim 13, wherein the plurality of switch transistors comprises a second transistor and a third transistor that are connected in series between the gate and the second terminal of the drive transistor.

16. The method of claim 15, wherein the first power supply is connected to a connection between the second transistor and the third transistor.

17. The method of claim 15, wherein the plurality of switch transistors further comprises a fourth transistor that electrically connects the second node to the data voltage during the combined threshold compensation and data programming phase.

18. The method of claim 17, wherein the plurality of switch transistors further comprises a fifth transistor that electrically connects the first node and the second node during the initialization phase and the emission phase.

19. The method of claim 18, wherein the plurality of switch transistors further comprises a sixth transistor that electrically connects the first node and the reference voltage during the initialization phase and the combined threshold compensation and data programming phase.

20. The method of claim 19, wherein the plurality of switch transistors further comprises a seventh transistor that electrically connects the first power supply to a connection between the second transistor and the third transistor during the initialization phase and the emission phase.

* * * * *